US005111195A

United States Patent [19]

Fukuoka et al.

[11] Patent Number: 5,111,195

[45] Date of Patent: May 5, 1992

[54] DRIVING CIRCUIT FOR A MATRIX TYPE DISPLAY DEVICE

[75] Inventors: Hirofumi Fukuoka, Osaka; Yoshiharu Kanatani, Nara, both of Japan

[73] Assignee: Sharp Kabushiki Kaisha, Osaka, Japan

[21] Appl. No.: 470,623

[22] Filed: Jan. 26, 1990

[30] Foreign Application Priority Data

Jan. 31, 1989 [JP] Japan ..... 1-23485
Jul. 17, 1989 [JP] Japan ..... 1-183950
Jul. 17, 1989 [JP] Japan ..... 1-183951

[51] Int. Cl.[5] ..... G09G 3/00

[52] U.S. Cl. ..... 340/811; 340/784; 358/236

[58] Field of Search ..... 340/784, 789, 798, 811, 340/812, 813, 793; 358/236, 241; 350/332, 333

[56] References Cited

U.S. PATENT DOCUMENTS

| | | | |
|---|---|---|---|
| 4,205,311 | 5/1980 | Kutaragi | 340/811 |
| 4,523,232 | 6/1985 | Kameda et al. | 358/236 |
| 4,525,710 | 6/1985 | Hoshi et al. | 340/784 |
| 4,570,115 | 2/1986 | Misawa et al. | 340/813 |
| 4,694,349 | 9/1987 | Takeda et al. | 358/236 |
| 4,769,639 | 9/1988 | Kawamura et al. | 340/811 |
| 4,781,437 | 11/1988 | Shields et al. | 340/784 |

FOREIGN PATENT DOCUMENTS

| | | |
|---|---|---|
| 3519793 | 6/1985 | Fed. Rep. of Germany . |
| 52-15170 | 4/1977 | Japan . |

OTHER PUBLICATIONS

European Search Report for EPC Application No. 90/300939.8, dated Apr. 30, 1990.

*Primary Examiner*—Alvin E. Oberley
*Assistant Examiner*—Xiao M. Wu
*Attorney, Agent, or Firm*—Morrison & Foerster

[57] ABSTRACT

A driving circuit for a matrix type display device in which a plurality of picture elements are arranged in a matrix is disclosed. The driving circuit comprises a video signal output circuit for supplying video signals through output portions to the display device at each horizontal scan. The video signal output circuit comprises for each of the output portions: a comparison circuit for comparing the level of a video signal to be output, with the level of the output portion which is caused by the video signal output at the previous horizontal scan; and an output level control circuit for, when the level of said video signal to be output is higher than the level of the output portion, raising the level of said output portion to the level substantially identical with the level of the video signal to be output, and, when the level of said video signal to be output is lower than the level of the output portion, lowering the level of said output portion to the level substantially identical with the level of the video signal to be output.

7 Claims, 6 Drawing Sheets

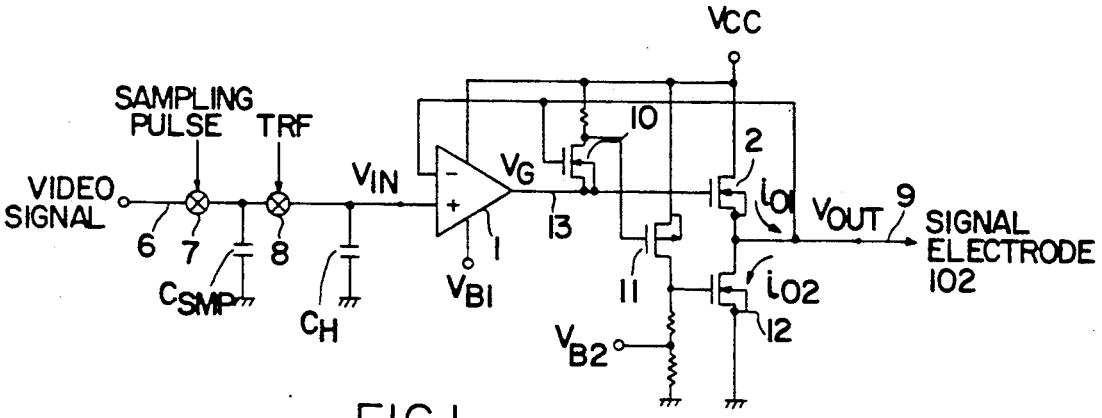
FIG.1
FIG.2(a)
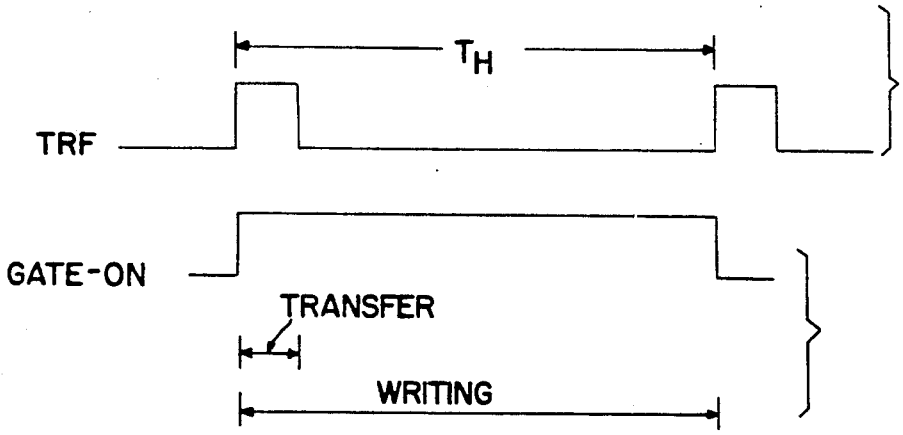
FIG.2(b)

FIG.5
PRIOR ART
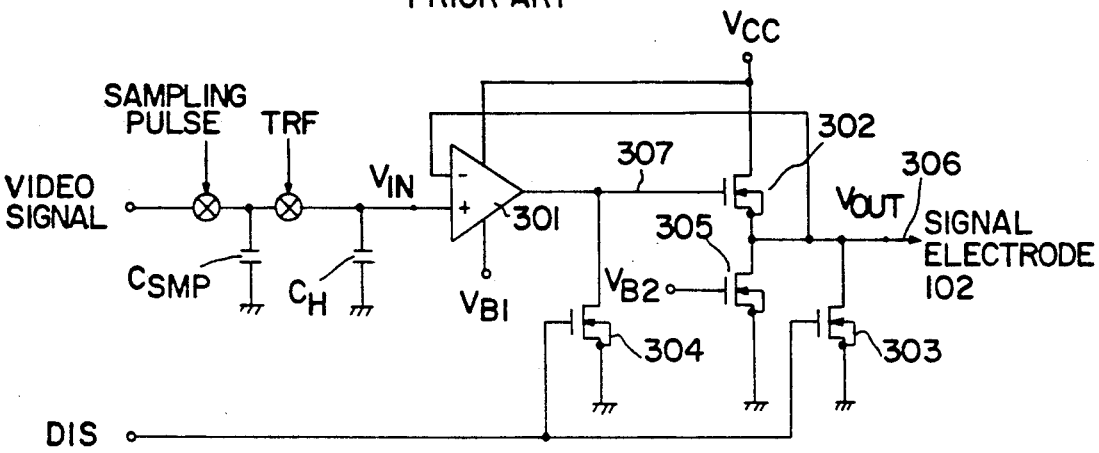
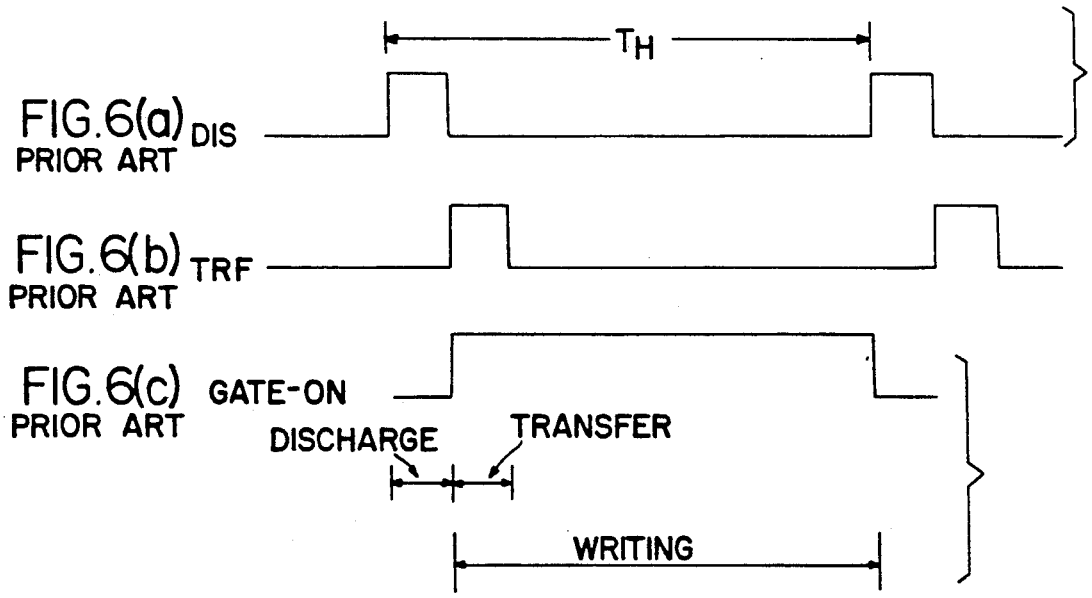

DRIVING CIRCUIT FOR A MATRIX TYPE DISPLAY DEVICE

BACKGROUND OF THE INVENTION

1. Field of the Invention

This invention relates to a driving circuit for a matrix type display device, and more particularly to a driving circuit for a matrix type liquid crystal display device.

2. Description of the Prior Art

Because of rapid advances in design and manufacturing technology in recent years, matrix type liquid crystal display devices are beginning to have a display quality which can match that of cathode-ray tubes. With its excellent features such as thin and light weight construction and low power consumption, a matrix liquid crystal display device is finding application in a variety of fields such as a display unit for a television receiver, a visual display unit for a personal computer and other information apparatus, and so on.

FIG. 3 shows one example of a conventional matrix type liquid crystal display device. The liquid crystal display device shown in FIG. 3 comprises a TFT liquid crystal display panel 100, a gate driver 200, and a source driver 300. In the display panel 100, picture elements 103 are arranged in a matrix of n rows and m columns, and thin-film transistors (TFTs) 104 are used as switching elements for driving the picture elements 103. Other transistors such as MOS transistors may be used as the switching elements. An array of the picture elements 103 arranged in a horizontal direction forms one horizontal scanning line. The TFTs 104 are respectively disposed adjacent to each picture elements 103. The drain of each TFT 104 is connected to an electrode of the corresponding picture elements 103. A counter electrode 105 is disposed as the other electrode which is common to all the picture elements 103. On the TFT liquid crystal display panel 100 are disposed an n number of scanning electrodes 101 parallel to one another. To the jth scanning electrode 101, the gates of the TFTs 104 corresponding to the picture elements 103 of the jth horizontal scanning line are connected. An m number of signal electrodes 102 are disposed parallel to one another and intersecting at right angles with the scanning electrodes 101. To the ith signal electrode 102, the sources of the TFTs 104 on the ith column are connected.

The TFT liquid crystal display panel 100 is driven by the gate driver 200 (vertical scanning means) and the source driver 300 (video signal output means). The gate driver 200 and the source driver 300 are connected to the scanning electrodes 101 and the signal electrodes 102, respectively. A video signal is input to the source driver 300. Control signals such as scanning pulses to the gate driver 200, and sampling clock pulses to the source driver 300 are fed from a control circuit not shown.

The display operation of the matrix type liquid crystal display device shown in FIG. 3 will be described with reference to FIG. 4. As shown in FIG. 4, the gate driver 200 applies a gate-on signal sequentially to the scanning electrodes 101 on the display panel 100. That is, the gate driver 200 scans the horizontal scanning lines in a predetermined sequence. A time TH is allotted to the scanning of one horizontal scanning line. When the jth scanning line is scanned, the TFT 104 connected to the jth scanning electrode 101 is turned on. The source driver 300 samples the input video signal at a predetermined frequency, and feeds the sampled video signal to the signal electrode 102 in synchronism with the gate-on signal output from the gate driver 200. Thus, the video signal is written in the picture element 103 through the activated TFT 104. The signal written in the picture element 103 is retained for a time $T_F$ till the next signal is written therein. In FIG. 4, $T_W$ indicates a period of time during which a video signal is written in a picture element.

The writing operation of the above-mentioned conventional driving circuit will be described in more detail referring to FIG. 5 which shows one of the output stages of the source driver 300. The output stage shown in FIG. 5 corresponds to one signal electrode 102.

The video signal is stored in a sampling capacitor $C_{SMP}$ when a sample pulse is input. Before writing the video signal into the corresponding picture element 103, a discharge signal DIS is turned HIGH, as shown in FIG. 6, to erase the previously written signal from the signal electrode 102. This causes the signal electrode 102 to be discharged through a transistor 303, resulting in that the potential of the signal electrode 102 drops to the ground level. Then, a transfer signal TRF is turned HIGH to transfer the video signal stored in the sampling capacitor $C_{SMP}$ to a hold capacitor $C_H$, while the video signal is output through an output circuit including a differential amplifier 301, an output transistor 302 and transistors 304 and 305, to the signal electrode 102 connected to an output line 306. The transistor 305 functions to supply a bias current. At the same time when the transfer signal TRF is turned HIGH, the gate driver 200 turns on the TFTs 104 connected the applicable scanning electrode 101, and the video signal on the signal electrode 102 is written into the picture elements 103 connected to the energized TFT 104.

In the above-mentioned conventional driving circuit, the source driver 300 is not provided with a means for lowering the voltage of the signal electrode 102 when the voltage level of an input signal $V_{IN}$ is lower than the voltage of the signal electrode 102. Therefore, it is necessary to discharge the signal electrode 102 by means of the discharge signal DIS prior to the writing. As is apparent from FIG. 6, the presence of the discharge signal DIS reduces the period of time for writing the video signal into the picture element 103. This causes the charge characteristic of the picture element 103 to be impaired, thereby hindering the improvement of the contrast of the matrix type liquid crystal display device.

Also, since all the signal electrodes 102 are discharged at the same time by the DIS signal, a large discharge current flows into the source driver 300. Furthermore, since the discharge of the signal electrodes is performed at every scanning of a horizontal scanning line, the source driver 300 consumes a large amount of power.

SUMMARY OF THE INVENTION

The driving circuit for a matrix type display device of this invention, which overcomes the above-discussed and numerous other disadvantages and deficiencies of the prior art, comprises a vertical scanning means for scanning each horizontal scanning line of said display device; and a video signal output means for supplying video signals through output portions to said display device at each horizontal scan, said video signal output means comprises for each of said output portions: a comparison means for comparing the level of a video signal to be output, with the level of the output portion which is caused by the video signal output at the previous horizontal scan; and an output level control means for, when the level of said video signal to be output is higher than the level of said output portion, raising the level of said output portion to the level substantially identical with the level of said video signal to be output, and, when the level of said video signal to be output is lower than the level of said output portion, lowering the level of said output portion to the level substantially identical with the level of said video signal to be output.

In a preferred embodiment, the comparison means comprises a detecting means for, when the level of said video signal to be output is lower than the level of said output portion, detecting the falling edge of said video signal.

In a preferred embodiment, the detecting means is a differential circuit.

In a preferred embodiment, the output level control means comprises two switching means, one of said two switching means being connected between said output portion and a voltage level of a predetermined level, the other of said two switching means being connected between said output portion and a ground level.

In a preferred embodiment, the two switching means are transistors.

In a preferred embodiment, the transistors have the same conductivity type as each other.

In a preferred embodiment, the transistors have a conductivity type different to each other.

Thus, the invention described herein makes possible the objectives of (1) providing a driving circuit for a matrix type display device in which it is not required to use the discharge signal; (2) providing a driving circuit for a matrix type display device by which the period of time for writing the video signal into the picture element can be prolonged; (3) providing a driving circuit for a matrix type display device by which the charge characteristic of the picture element can be improved; (4) providing a driving circuit for a matrix type display device by which the contrast of the matrix type liquid crystal display device can be improved; (5) providing a driving circuit for a matrix type display device in which it is not necessary to discharge the picture elements at every horizontal scanning; and (6) providing a driving circuit for a matrix type display device which consumes less power.

BRIEF DESCRIPTION OF THE DRAWINGS

This invention may be better understood and its numerous objects and advantages will become apparent to those skilled in the art by reference to the accompanying drawings as follows:

FIG. 1 is a circuit diagram illustrating an output stage of a driving circuit according to the invention.

FIGS. 2*a–b* are a timing chart illustrating the operation of the driving circuit shown in FIG. 1.

FIG. 5 is a circuit diagram illustrating an output stage of a conventional driving circuit.

FIGS. 6*a–c* are a timing chart illustrating the operation of the driving circuit shown in FIG. 5.

DESCRIPTION OF THE PREFERRED EMBODIMENTS

Figure 3:
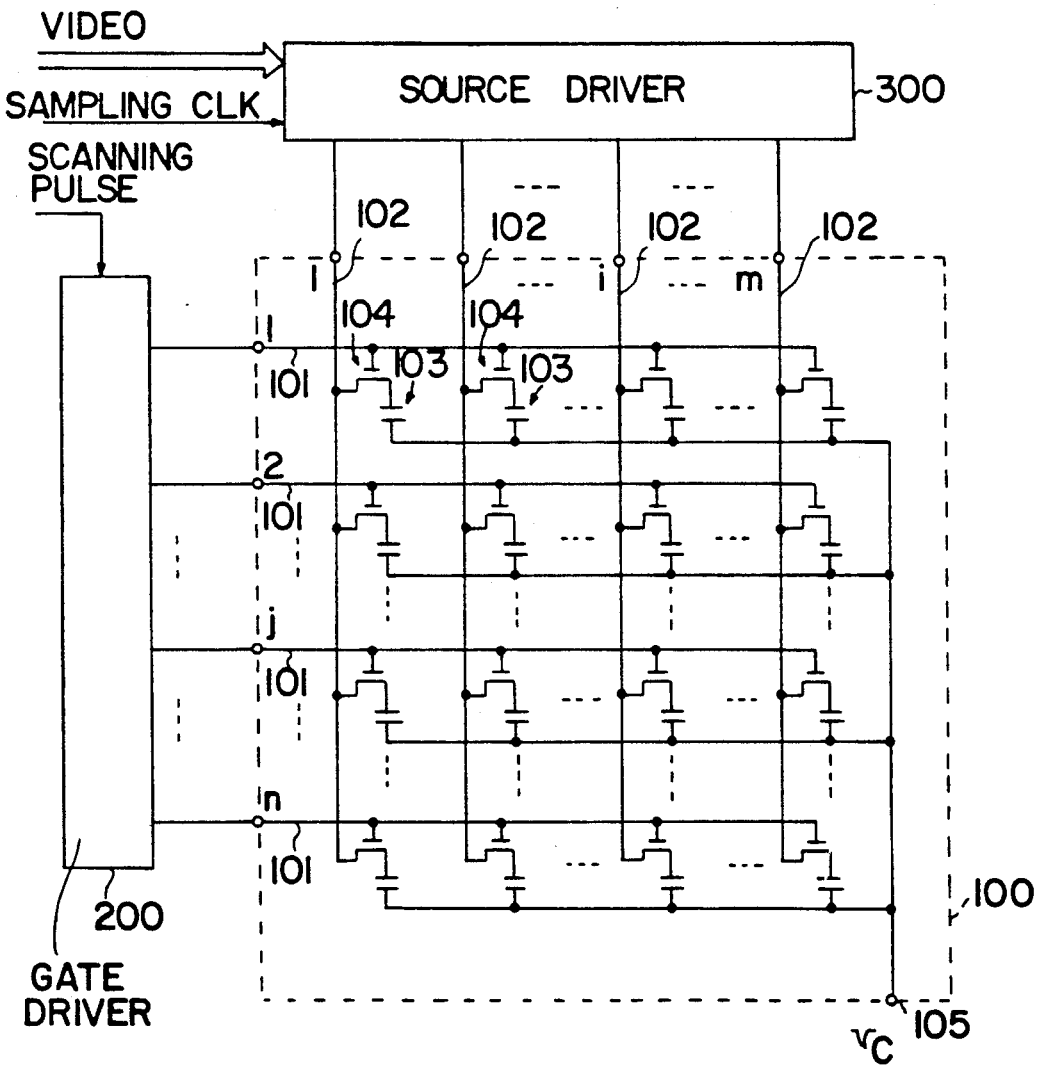
FIG. 3 illustrates diagrammatically a driving circuit and a matrix type liquid crystal display device.
Figure 4:
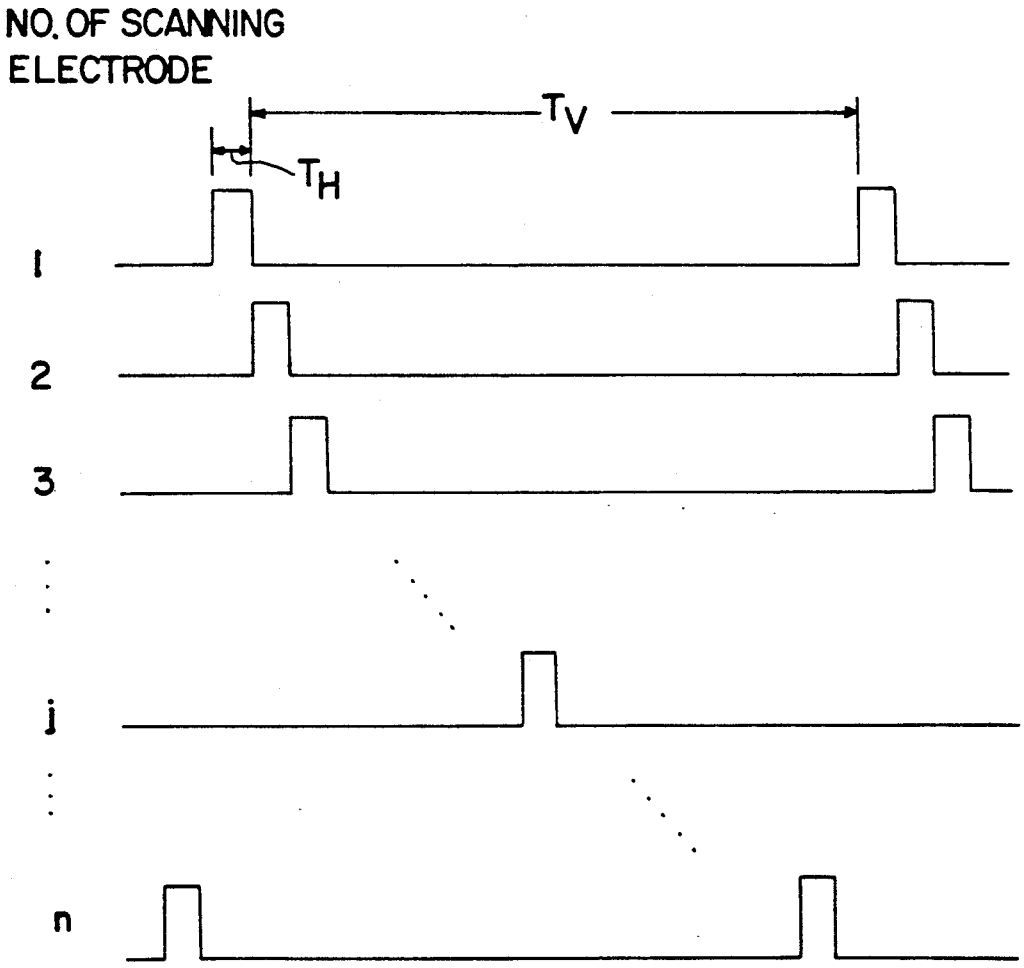
FIG. 4 is a timing chart of the gate-on signal in the display device shown in FIG. 3.

A driving circuit according to the invention is used for driving a matrix type liquid crystal display device will be described. This driving circuit comprises a gate driver and a source driver in a manner similar to the driving circuit illustrated in FIG. 3. The source driver in the driving circuit of the preferred embodiment comprises the output stage shown in FIG. 1. An input line 6 on which a video signal is input is connected to a non-inverted input terminal of a differential amplifier 1 through analog switches 7 and 8. As in the circuit shown in FIG. 5, a sampling capacitor $C_{SMP}$ and a hold capacitor $C_H$ are connected to the input line 6. An output 13 of the differential amplifier 1 is connected to the gate of a first output transistor 2. The source of the first output transistor 2 (N-channel) is connected to an output line 9. An output signal (video signal) is supplied from the first output transistor 2 to the signal electrode of the display device through the output line 9. The output line 9 is also connected to an inverted input terminal of the differential amplifier 1. A transistor 10 is connected between a power source $V_{CC}$ and the output 13 of the amplifier 1. The gate of the transistor 10 is connected to the output line 9. The transistor 10 compares an output signal level $V_G$ of the differential amplifier 1 with a voltage $V_{OUT}$ on the output line 9. The voltage $V_{OUT}$ appearing on the output line 9 corresponds to the one written in the picture element in the previous horizontal scanning onto the picture element. An output control transistor 11 is disposed between the power source $V_{CC}$ and the ground. The gate of the transistor 11 is connected to the drain of the transistor 10. Connected between the source of the first output transistor 2 and the ground is a second output transistor 12 (N-channel). The gate of the second output transistor 12 is connected to the source of the output control transistor 11. In the embodiment of FIG. 1, the capacitors $C_{SMP}$ and $C_H$ and transistor 12 are connected to the ground (OV). Alternatively, these components may be connected to a minus voltage level of a predetermined level (e.g., −12V).

The operation of the circuit of FIG. 1 will be described. When a sampling pulse is supplied to the analog switch 7, the video signal is stored in a sampling capacitor $C_{SMP}$. Then, a transfer signal TRF coupled to the analog switch 8 is turned HIGH to transfer the video signal stored in the sampling capacitor $C_{SMP}$ to the hold capacitor $C_H$. Also, the video signal is input to the differential amplifier 1. Since the differential amplifier 1 operates as a non-inverting amplifier, the output voltage $V_G$ of the differential amplifier 1 varies in accordance with the level change of the input video signal.

When the voltage $V_G$ appearing at the output 13 of the amplifier 1 is higher than the voltage $V_{OUT}$ on the output line 9, the first output transistor 2 is turned on so that a charge current $i_{01}$ flows from first output transistor 2 to the output line 9. As a result, the voltage $V_{OUT}$ is raised till it equals a voltage $V_{IN}$ input to the non-inverted terminal of the differential amplifier 1. In this period, the transistors 10, 11 and 12 remain off.

On the other hand, when the voltage $V_G$ is lower than the voltage $V_{OUT}$ (i.e., when the level of the input signal $V_{IN}$ is low), a drain current flows from the transistor 10 so that the drain voltage of the transistor 10 controls the gate of the output control transistor 11. This causes a drain current to flow from the output control transistor 11, thereby the second output transistor 12 is turned on to flow a discharge current $i_{02}$. As a result, the voltage $V_{OUT}$ is reduced till it equals the voltage $V_{IN}$.

Thus, in the driving circuit of this embodiment, there is no need to conduct the discharge of the signal electrodes using the discharge signal DIS. That is, according to this driving circuit, the signal electrodes are not always discharged at every horizontal scanning. As shown in FIG. 2, by using the driving circuit of this embodiment, all of the period of time $T_H$ allotted to the scanning of one horizontal scanning line can be used for the writing operation on the picture element. In FIG. 2, (*b*) shows the gate-on signal applied from the gate driver 200 to the scanning electrode 101.

Figure 7:
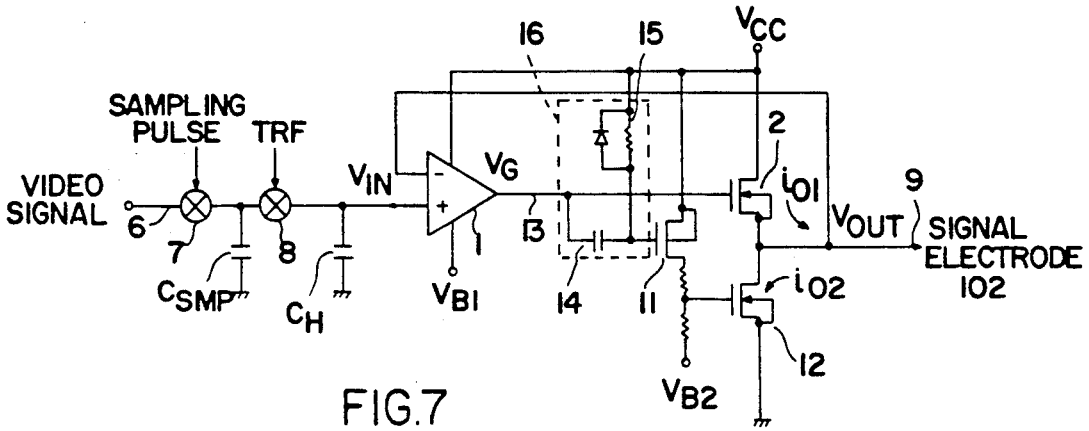
FIG. 7 is a circuit diagram illustrating an output stage of another driving circuit according to the invention.

FIG. 7 illustrates the output stage of another driving circuit according to the invention. In the embodiment shown in FIG. 7, a differential circuit 16 is used instead of the transistor 10 employed in the embodiment of FIG. 1. The differential circuit 16 comprises a capacitor 14 connected between the output 13 and the gate of the output control transistor 11, and a resistor 15 connected between the power source $V_{CC}$ and the gate of the output control transistor 11. When the voltage $V_G$ appearing at the output 13 of the amplifier 1 is higher than the voltage $V_{OUT}$ on the output line 9, the circuit of FIG. 7 operates in a similar manner as that of FIG. 1. When the voltage $V_G$ is lower than the voltage $V_{OUT}$, the differential circuit 16 generates a negative pulse voltage at the falling edge of the voltage $V_G$. This pulse voltage is applied to the gate of the output control transistor 11 so that the transistor is turned on. Thereby, a drain current flows from the transistor 11, and the second output transistor 12 is turned on to flow a discharge current $i_{02}$. As a result, the voltage $V_{OUT}$ is reduced till it equals the voltage $V_{IN}$.

Figure 8:
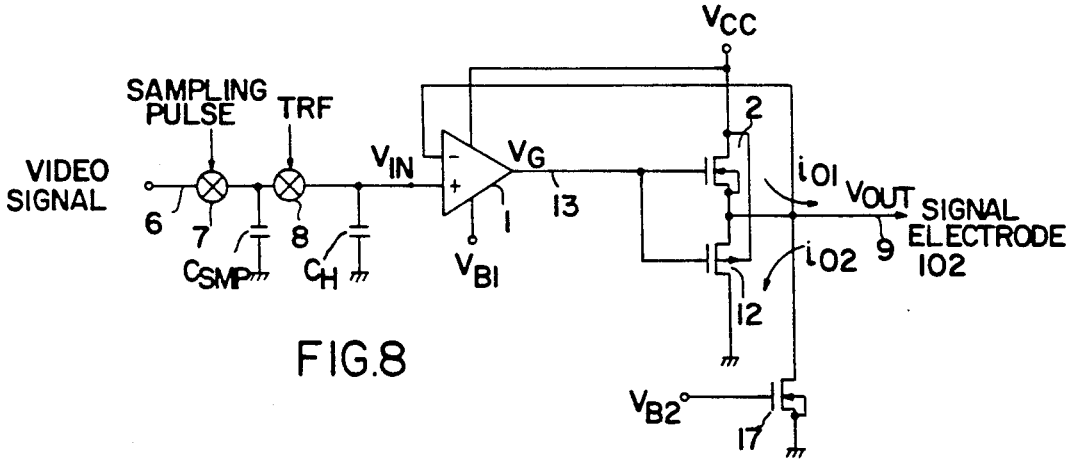
FIG. 8 is a circuit diagram illustrating an output stage of a further driving circuit according to the invention.
Figure 9:
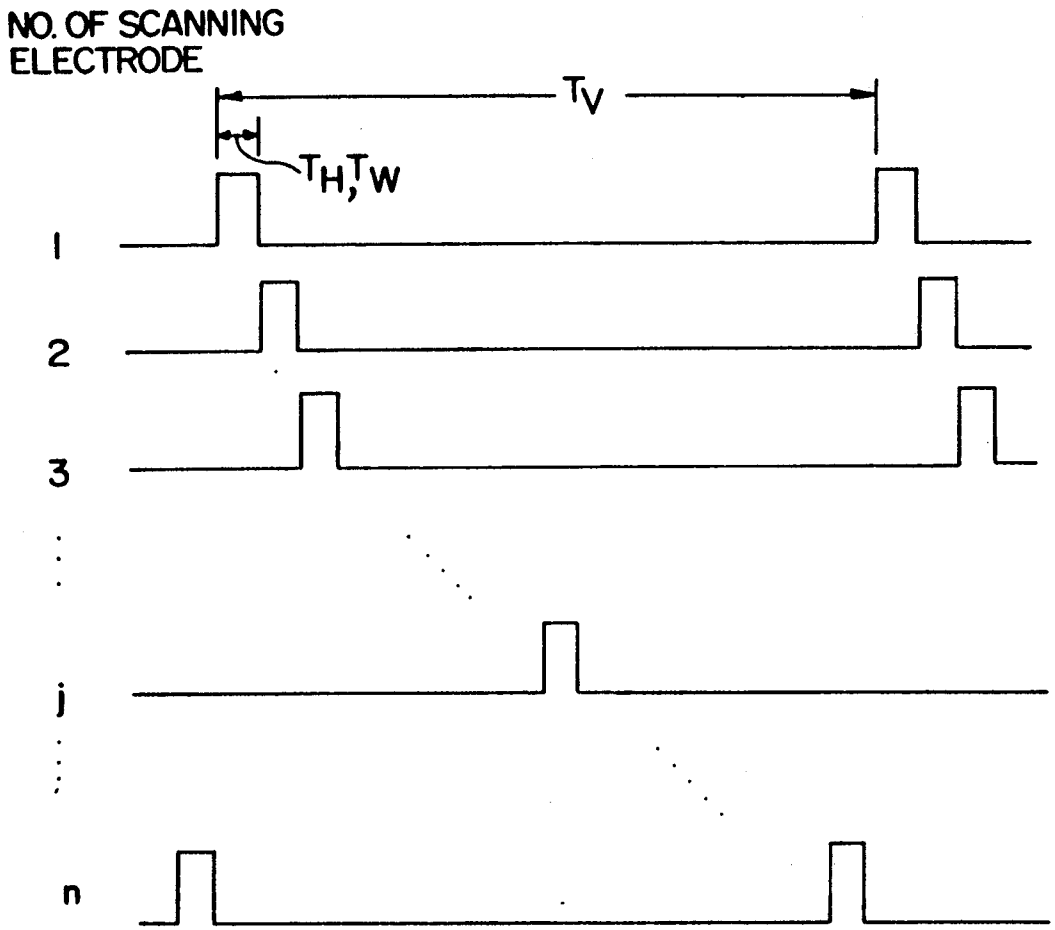
FIG. 9 is a timing chart of the gate-on signal in the display device shown in FIG. 1.

FIG. 8 illustrates the output stage of a further driving circuit according to the invention. In the embodiment shown in FIG. 8, the second output transistor 12 is a P-channel transistor, and its gate is directly connected to the output 13 of the differential amplifier 1. A transistor 17 for setting a bias voltage is connected between the output line 9 and the ground. The output control transistor 11 and the transistor 12 or the differential circuit 16 are not used in this embodiment. When the voltage $V_G$ appearing at the output 13 of the amplifier 1 is higher than the voltage $V_{OUT}$ on the output line 9, the voltage $V_G$ controls the gate of the first output transistor 2 (N-channel) to turn on it so that a charge current $i_{01}$ flows from first output transistor 2 to the output line 9. As a result, the voltage $V_{OUT}$ is raised till it equals a voltage $V_{IN}$ input to the non-inverted terminal of the differential amplifier 1. On the other hand, when the voltage $V_G$ is lower than the voltage $V_{OUT}$ (i.e., when the level of the input signal $V_{IN}$ is low), the voltage $V_G$ controls the second output transistor 12 (P-channel) to turn on it so that a discharge current $i_{02}$ flows from the output line 9 to the ground. As a result, the voltage $V_{OUT}$ is reduced till it equals the voltage $V_{IN}$.

According to a driving circuit of the invention, as compared with a conventional driving circuit, the charge characteristic of the pixel and the contrast of a display device can be greatly improved. Also, since the need for the current associated with the discharge is eliminated, current is only needed for closing the gap between the input voltage $V_{IN}$ and the output voltage $V_{OUT}$, which substantially reducing the power consumption of the display device including the driving circuit. Moreover, according to the present invention, a driving circuit for a matrix type liquid crystal display device can improve the contrast of the display and reduce the power consumption of the display.

In the field of a matrix type liquid crystal display device, it is expected that efforts will be made for a larger display screen and a higher resolution. This will necessitate a further reduction in the writing time on the picture elements. Furthermore, when considering the fact that a larger screen requires larger source and gate capacities in the display panel as well as longer signal delays, the conditions of writing video signals into picture elements are expected to become more severe. The present invention offers great advantages in coping with such a situation.

Also, since a higher resolution leads to an increased number of pins for an IC chip incorporating a driving circuit, it is expected that high density packing techniques will be required. The technique of COG (Chip On Glass) is considered to be the most promising as a high density packing technique. The reduced power consumption achieved by the present invention is also very useful in accomplishing the high density packing by COG.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. In a driving circuit for a matrix type display device in which a plurality of picture elements are arranged in a matrix, comprising: a vertical scanning means for scanning each horizontal scanning line of said display device; and a video signal output means for supplying video signals through output portions to said display device at each horizontal scan, said output portions being respectively connected to vertical signal lines of said display device, said video signal output means comprises for each of said output portions:

a comparison means for comparing the level of a video signal to be output, with the level of the respective vertical signal line which is caused by the video signal output at the previous horizontal scan; and an output level control means for, when the level of said video signal to be output is higher than the level of said vertical signal line, raising the level of said vertical signal line to the level substantially identical with the level of said video signal to be output, and, when the level of said video signal to be output is lower than the level of said vertical signal line, lowering the level of said vertical signal line, lowering the level of said vertical signal line to the level substantially identical with the level of said video signal to be output.

2. In a driving circuit for a matrix type display device in which a plurality of picture elements are arranged in a matrix, comprising: a vertical scanning means for scanning each horizontal scanning line of said display device; and a video signal output means for supplying video signals through output portions to said display device at each horizontal scan, said video signal output means comprises for each of said output portions:

a comparison means for comparing the level of a video signal to be output, with the level of the output portion which is caused by the video signal output at the previous horizontal scan; and an output level control means for, when the level of said video signal to be output is higher than the level of said output portion, raising the level of said output portion to the level substantially identical with the level of said video signal to be output, and, when the level of said video signal to be output is lower than the level of said output portion, lowering the level of said output portion to the level substantially identical with the level of said video signal to be output, said comparison means comprising a detecting means for, when the level of said video signal to be output is lower than the level of said output portion, detecting the falling edge of said video signal.

3. A driving circuit according to claim 2 wherein said detecting means is a differential circuit.

4. In a driving circuit for a matrix type display device in which a plurality of picture elements are arranged in a matrix, comprising: a vertical scanning means for scanning each horizontal scanning line of said display device; and a video signal output means for supplying video signals through output portions to said display device at each horizontal scan, said video signal output means comprises for each of said output portions:

a comparison means for comparing the level of a video signal to be output, with the level of the output portion which is caused by the video signal output at the previous horizontal scan; and an output level control means for, when the level of said video signal to be output is higher than the level of said output portion, raising the level of said output portion to the level substantially identical with the level of said video signal to be output, and, when the level of said video signal to be output is lower than the level of said output portion, lowering the level of said output portion to the level substantially identical with the level of said video signal to be output, said output control means comprising two switching means, one of said two switching means being connected between said output portion and a voltage level of a predetermined level, the other of said two switching means being connected between said output portion and a ground level.

5. A driving circuit according to claim 4 wherein said two switching means are transistors.

6. A driving circuit according to claim 5 wherein said transistors have the same conductivity type as each other.

7. A driving circuit according to claim 5 wherein said transistors have a conductivity type different to each other.

* * * * *